United States Patent [19]

Ueda

[11] Patent Number: 4,803,055

[45] Date of Patent: Feb. 7, 1989

[54] APPARATUS FOR STERILIZING CONTAINERS

[75] Inventor: Michio Ueda, Tokushima, Japan

[73] Assignee: Shikoku Kakoki Co., Ltd., Tokushima, Japan

[21] Appl. No.: 90,989

[22] Filed: Aug. 31, 1987

[30] Foreign Application Priority Data

Sep. 24, 1986 [JP] Japan ..... 61-226426

[51] Int. Cl.[4] ..... A61L 2/00; B08B 3/08; B08B 9/08

[52] U.S. Cl. ..... 422/297; 422/300; 422/303; 422/304; 134/48; 134/62; 134/73

[58] Field of Search ..... 422/297, 300, 303, 304, 422/905; 134/48, 62, 68, 73, 75

[56] References Cited

U.S. PATENT DOCUMENTS

| | | | |
|---|---|---|---|
| 797,298 | 8/1905 | Lowe | 422/304 X |
| 1,734,585 | 11/1929 | Ladewig et al. | 422/304 X |
| 2,673,567 | 3/1954 | Fruhling | 134/62 |
| 3,079,936 | 3/1963 | Hockett et al. | 134/73 |
| 3,129,713 | 4/1964 | Read | 134/73 |
| 3,575,713 | 4/1971 | Duff et al. | 422/304 X |

*Primary Examiner*—Barry S. Richman
*Assistant Examiner*—Lynn Kummert
*Attorney, Agent, or Firm*—Armstrong, Nikaido, Marmelstein & Kubovcik

[57] ABSTRACT

An apparatus for sterilizing containers comprises a closed sterilized chamber having a container inlet and a container outlet, an antiseptic vessel and a rinse vessel arranged within the sterilized chamber, and a group of container transport devices for transporting each container within the sterilized chamber from the inlet to the outlet by way of the vessels.

4 Claims, 4 Drawing Sheets

APPARATUS FOR STERILIZING CONTAINERS

BACKGROUND OF THE INVENTION

The present invention relates to an apparatus for sterilizing containers such as plastic bottles.

Such sterilizing apparatus are known which employ an antiseptic solution of hydrogen peroxide and which are adapted to spray the solution onto containers with a nozzle and thereafter apply hot air to the containers to remove the solution therefrom by evaporation.

The known apparatus has no problem when handling containers having a large mouth such as those in the form of a cup or hollow cylinder, but encounters difficulty in uniformly applying the antiseptic solution to the inner surface of containers, such as bottles, provided with a mouth which has a smaller diameter than the trunk portion thereof. Further if drops of the antiseptic solution remain in the interior of the container, the container requires a long period of time for drying.

SUMMARY OF THE INVENTION

The main object of the present invention is to provide an apparatus for sterilizing containers free of the above problems.

The apparatus of the invention for sterilizing containers comprises a closed sterilized chamber having a container inlet and a container outlet, an antiseptic vessel and a rinse vessel which are arranged within the sterilized chamber, and a group of container transport means for transporting each container within the sterilized chamber from the inlet to the outlet by way of the vessels.

According to the present invention, containers are sterilized in the sterilized chamber while being transported from the inlet to the outlet. This obviates the likelihood that the sterilized container will be contaminated again.

The container is brought into the antiseptic vessel and transported through this vessel as immersed in an antiseptic solution therein, whereby the container is sterilized. This permits the solution to uniformly wet the inner surface of the container, further assuring sterilization for a required period of time since the transport time can be set to the period of time required for the sterilization.

Since the container is further transported through the rinse vessel in the same manner as in the antiseptic vessel, the rinse completely washes away the antiseptic solution from the container without permitting the solution to remain in the container.

DESCRIPTION OF THE PREFERRED EMBODIMENTS

An embodiment of the invention will be described below with reference to the drawings.

Figure 1:
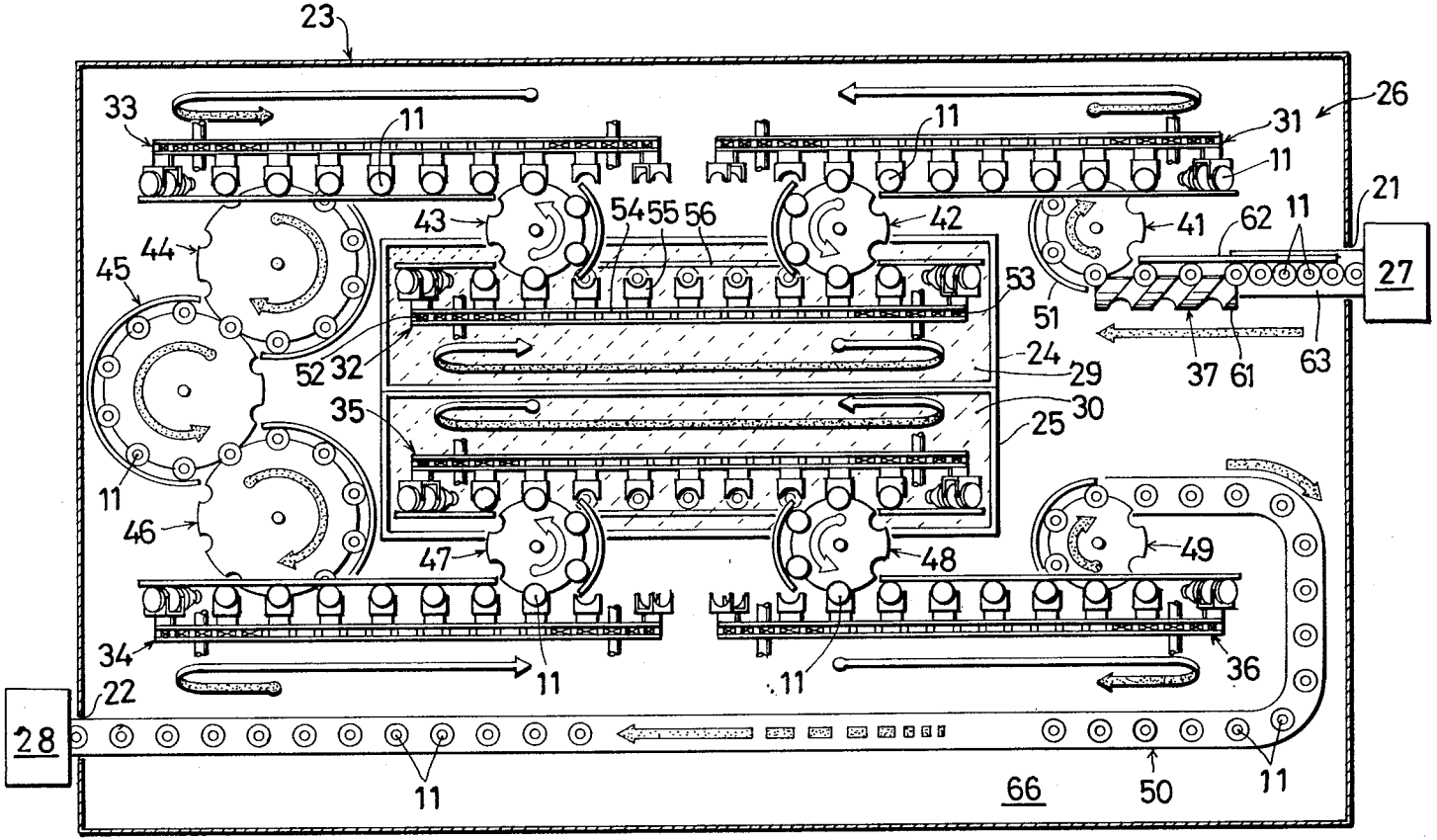
FIG. 1 is a plan view in section along a plane and showing an embodiment of the invention.
Figure 2:
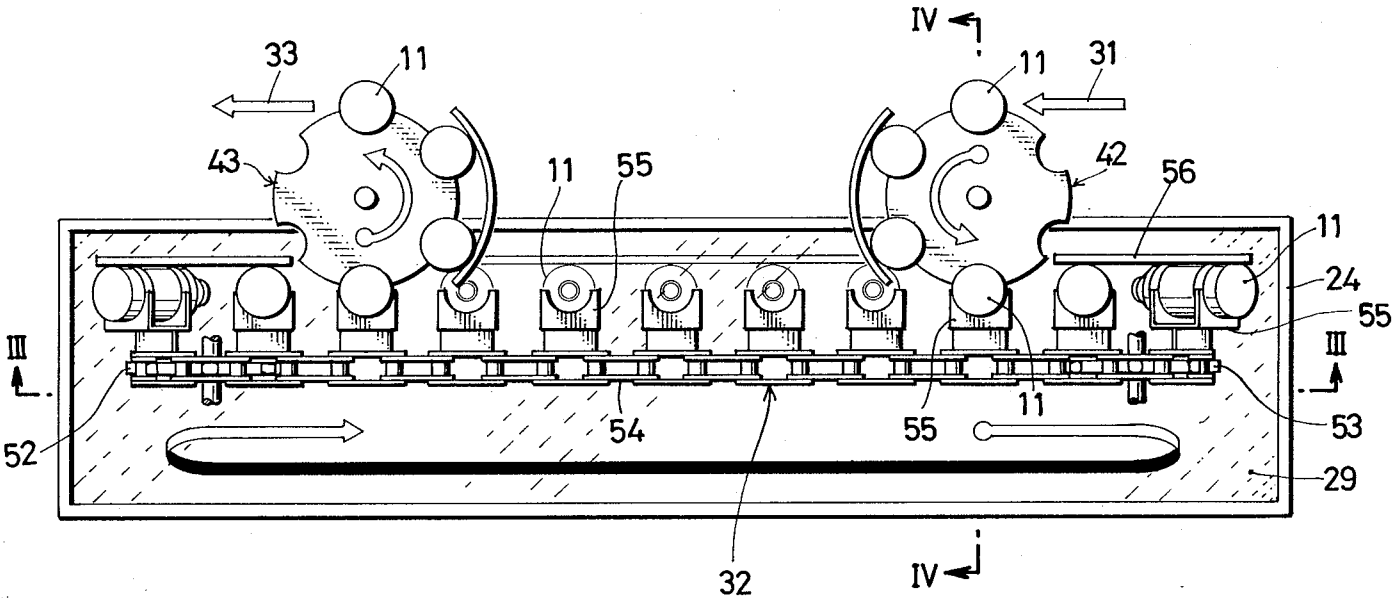
FIG. 2 is a plan view showing a portion of FIG. 1 on an enlarged scale.

In the following description, the terms "right" and "left" are used with reference to FIG. 1; the right-hand side of FIG. 1 is referred to as "right," and the opposite side as "left." Similarly, the term "front" refers to the upper side of FIG. 1, and the term "rear" to the opposite side.

The container 11 to be sterilized by the apparatus of the invention is a plastic bottle and has a trunk 12 and a mouth 13 which is smaller than the trunk 12 in diameter. The trunk 12 is formed with upper and lower two annular grooves 14 which are spaced apart by a specified distance. With reference to FIG. 1, the container sterilizing apparatus comprises a closed sterilized chamber 23 having a container inlet 21 and a container outlet 22, an antiseptic vessel 24 and a rinse vessel 25 which are arranged within the chamber 23, and a group of container transport means, 26, for transporting each container 11 within the sterilized chamber 23 from the inlet 21 to the outlet 22, first via the vessel 24 and then via the vessel 25.

When seen from above, the sterilized chamber 23 is in the form of a rectangle elongated in the right-to-left direction. The inlet 21 is formed in the right side wall of the chamber 23 and is adjacent to a unit 27 for aligning containers 21 in an upright position. The outlet 22 is formed in the left side wall of the chamber 23 and is adjacent to a sterilized filling unit 28.

The antiseptic vessel 24 and the rinse vessel 25 are each in the form of a rectangle elongated in the right-to-left direction when seen from above, and are arranged side by side in the front-to-rear direction in the center of the sterilized chamber 23. The vessel 24 contains an aqueous solution of ozone serving as an antiseptic solution 29. An aqueous solution of hydrogen peroxide is usable in place of the ozone solution. The vessel 25 contains sterilized water serving as a rinse 30.

The group of container transport means, 26, comprises conveyors and star wheels. More specifically, the group 26 includes a first chain conveyor 31 disposed in front of the antiseptic vessel 24 at the right thereof, a second chain conveyor 32 disposed within the vessel 24, a third chain conveyor 33 disposed in front of the vessel 24 at the left thereof, a fourth chain conveyor 34 disposed in the rear of the rinse vessel 25 at the left thereof, a fifth chain conveyor 35 disposed within the vessel 25 and a sixth chain conveyor 36 disposed in the rear of the vessel 25 at the right thereof. The group 26 further includes a container feed screw conveyor 37 extending rightward from the inlet 21, a first star wheel 41 interposed between the left end of the conveyor 37 and the right end of the first chain conveyor 31, a second star wheel 42 interposed between the right end of the first chain conveyor 31 and the second chain conveyor 32, a third star wheel 43 interposed between the left end of the second chain conveyor 32 and the right end of the third chain conveyor 33, three fourth to sixth star wheels 44 to 46 arranged between the left end of the third chain conveyor 33 and the lefr end of the fourth chain conveyor 34 rearward, a seventh star wheel 47 interposed between the right end of the fourth chain conveyor 34 and the left end of the fifth chain, conveyor 35, an eighth star wheel 48 interposed between the right end of the fifth chain conveyor 35 and the left end of the sixth chain conveyor 36, a ninth star wheel 49 disposed in front of the right end of the sixth chain conveyor 36 and a container discharge roller conveyor 50 extending from a position in front of the ninth star wheel 49 to the outlet 22.

Figure 3:
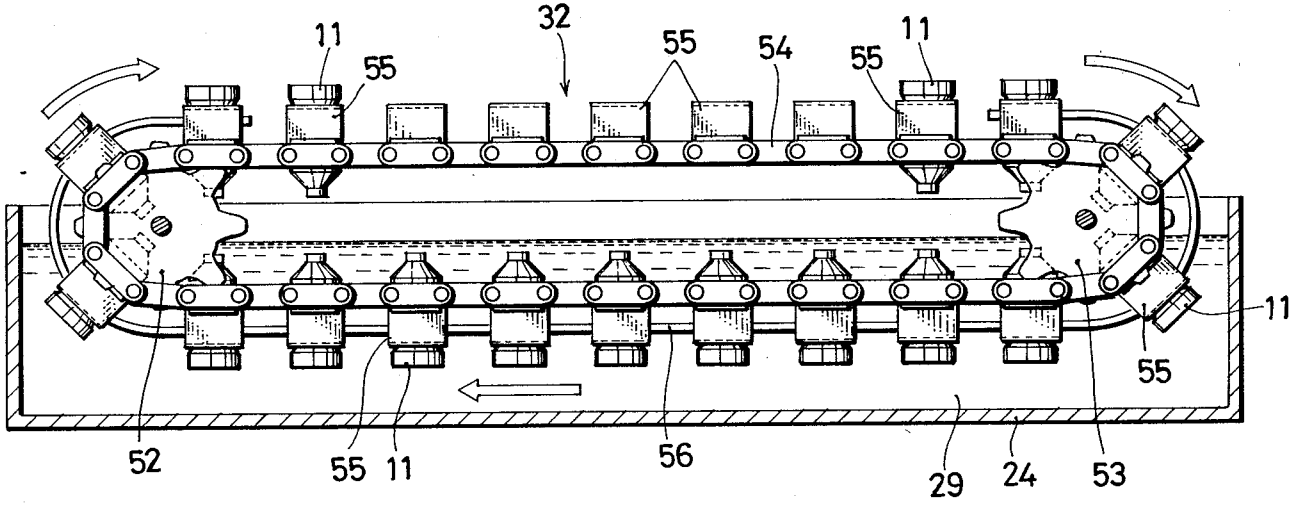
FIGS. 3 and 4 are views in section taken respectively along the line III—III and the line IV—IV in FIG. 2.
Figure 4:
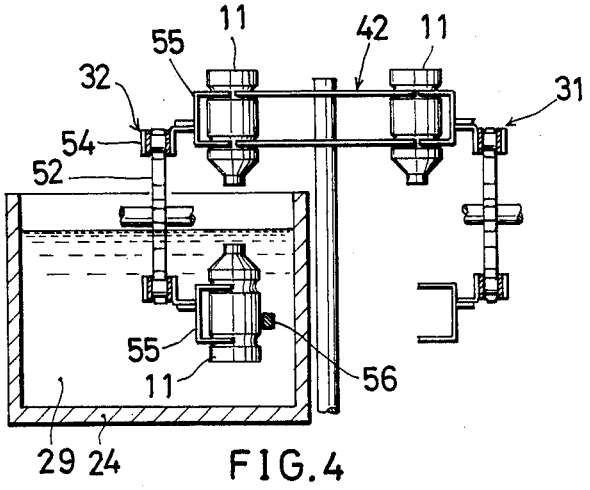
Figure 5:
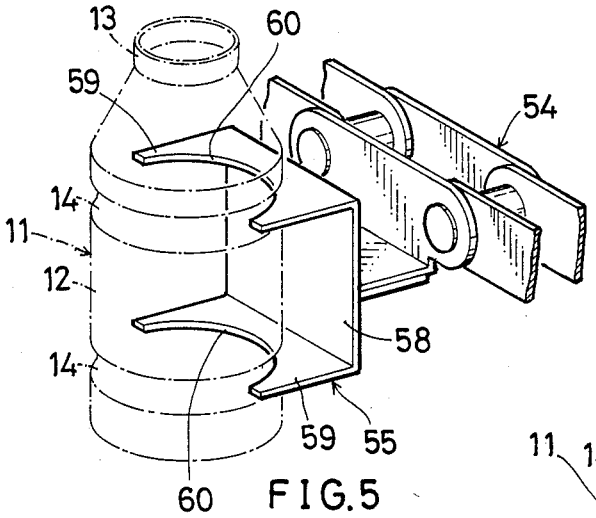
FIG. 5 is an enlarged perspective view of a container holder.
Figure 6:
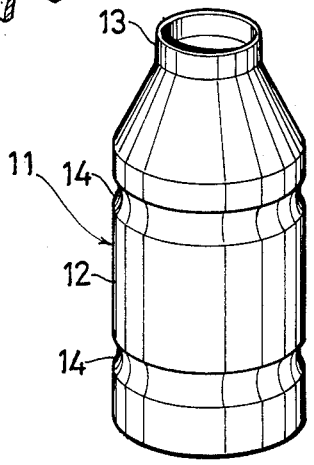
FIG. 6 is a perspective view of a container.

The first to sixth chain conveyors 31 to 36 are positioned at the same level and have the same construction. However, the first, third and fifth chain conveyors 31, 33, 35 are in opposite relation to the second, fourth and sixth chain conveyors 32, 34, 36 in orientation with respect to the front-to-rear direction. The second chain conveyor 32, which is typical of the first to sixth chain conveyors 31 to 36, will be described with reference to FIGS. 3 and 4. The conveyor 32 comprises left and right sprocket wheels 52, 53, an endless chain 54 reeved around these sprocket wheels and a multiplicity of container holders 55 mounted on the chain 54 and spaced equidistantly. A guide rail 56 in front of the path of travel of the holders 55 extends alongside the path over a required section thereof. As shown in greater detail in FIG. 5, each holder 55 is channel-shaped and includes a web 58 and two flanges 59. The web 58 is attached to the chain 54 so that the flanges 59 project forward from the chain 54. The distance between the two flanges 59 is equal to the distance between the two annular grooves 14 in the trunk 12 of the container. Each flange 59 has a front edge 60 which is recessed in the form of a circular arc when seen from above so as to position along the bottom of the annular groove 14. The holder 55 supports the container 11 as held between the guide rail 56 and the flange front edges 60 engaged in the annular grooves 14. The lower half of the second chain conveyor 32 is positioned in the antiseptic solution 29. The two sprocket wheels 52, 53 of the conveyor 32 are driven clockwise in FIG. 3. The lower half of the fifth chain conveyor 35 is immersed in the rinse 30 although not shown. The two sprocket wheels of the conveyor 35 are driven counterclockwise when seen from the rear.

The screw conveyor 37 comprises a screw rod 61 extending in the front-to-rear direction, a guide rail 62 disposed in front of the screw rod 61 for holding the container 11 therebetween, and a guide plate 63 disposed below the space between the screw rod 61 and the guide rail 62 for supporting the bottoms of containers 11 to guide the containers. The screw rod 61 has at its one end close to the inlet 21 a tooth pitch corresponding to the center-to-center distance between two containers 11 which are in contact with each other, and the pitch gradually increases leftward eventually to a value corresponding to the center-to-center distance between two adjacent containers 11 as transported by the first star wheel 41. Thus, the lead of the screw rod 61 increases leftward.

Although a detailed description will not be given of the first to ninth star wheels 41 to 49, these wheels have a known configuration and are substantially identical in construction. However, five start wheels, i.e. the first, fourth, fifth, sixth and ninth 41, 44, 45, 46 and 49, are at the same level as the lower side of path of travel of the chain conveyors 31 to 37, while the other four start wheels, i.e. the second, third, seventh and eighth 42, 43, 47 and 48, are at the same level as the upper side of the path. Each of the star wheels 41 to 49 is provided with a guide rail 51 in the form of a circular arc. (The rail for the first star wheel only is indicated by the reference number.)

Although not shown, hot air discharge nozzles are arranged along the path of transport by the discharge roller conveyor 50 to provide a drying zone 66 along the transport path.

The containers 11 brought into the sterilized chamber 23 through the inlet 21 are transported in succession to the second star wheel 42 by the screw conveyor 37, the first star wheel 41 and the first chain conveyor 31. Each of the containers 11 is transferred to the second star wheel 42 with its mouth 13 down and is delivered in this state from the wheel 42 to the second chain conveyor 32 at a position close to the terminal end of the upper side of the path of travel of the conveyor 32. Although the container 11 delivered to the conveyor 32 is positioned with its mouth 13 down while in the upper side of the path, the orientation of the container is gradually changed as the container approaches the lower side of the path, and the mouth 13 is directed completely upward when the container almost comes to the lower side of the path. While the container 11 turns its mouth 13 upward from the inverted position in this way, the antiseptic solution 29 flows into the container 11 through the mount 13 and fills up the container 11. The container 11 further forwarded along the lower side of the path gradually changes its orientation as it approaches the upper side of the path at the terminal end of the lower side. The container 11 comes into the upper side of the path with its mouth 13 directed downward again, allowing the antiseptic solution filling the container to flow out therefrom. The container 11 is then transported to the seventh star wheel 47 by the third star wheel 43, the third chain conveyor 33, the fourth to sixth star wheels 44 to 46 and the fourth chain conveyor 34, and is thereafter transferred from the wheel 47 to the fifth chain conveyor 35 with its mounth down 13. While being transported through the rinse vessel 25 by the fifth chain conveyor 35, the container 11 is filled with the rinse 30 and then drained of the rinse 30 in the same manner as in the antiseptic vessel 24. The container 11 is thereafter transported to the outlet 22 by the eighth star wheel 48, the sixth chain conveyor 36, the ninth star wheel 49 and the discharge roller conveyor 50. The container is dried while being transported by the roller conveyor 50 and is eventually discharged from the outlet 22.

What is claimed is:

1. An apparatus for sterilizing containers having an open top and closed bottom comprising:

a closed sterilized chamber having a container inlet and a container outlet;

an antiseptic vessel and a rinse vessel arranged within the sterilized chamber, and a group of container transport means for transporting a plurality of containers, one container after another from said container inlet, through said sterilized chamber, to said container outlet by way of said antiseptic vessel and said rinse vessel, one of said group of container transport means in each of said antiseptic vessel and saif rinse vessel, each including means for rotating each container, one after another, as each container enters each of said vessels, 180 degrees so that the open top of each container is in the up position, for transporting each container with its open top in the up position through each of said vessels and for again rotating each container 180 degrees as each container is being withdrawn form each of said vessels so that the open top of each container is in the down position.

2. An apparatus as defined in claim 1 wherein said group of container transport means includes a first container transport assembly for feeding each container, one container after another into the antiseptic vessel with the open top of each container in the down position, rotating each container 180 degrees so that the open top of each container is facing up as the container enters said antiseptic vessel, transporting each container with its open top up through said antiseptic vessel and immersing each container in an antiseptic solution in said antiseptic vessel, rotating each container 180 degrees so that the open top of each container is facing down as each container is fed by said transport means out of said antiseptic vessel and discharging each container from the antiseptic vessel with its open top down; and a second container transport assembly for feeding each container discharged from the antiseptic vessel into the rinse vessel with its open top down, rotating each container 180 degrees so that the open top of each container is up as each container enters said rinse vessel, transporting each container with its open top up through said rinse vessel and immersing each container, with its open top up, in a rinse in said rinse vessel, and rotating each container 180 degrees so that the open top of each container is facing down as each container is fed by transport means out of said rinse vessel.

3. An apparatus as defined in claim 2 wherein the first and the second container transport assemblies are provided for the antiseptic vessel and the rinse vessel, respectively, and each comprise a chain conveyor and a guide rail, said chain conveyor comprising two sprocket wheels horizontally spaced from each other within each of the vessels and having horizontal rotary shafts parallel to each other, a sprocket wheel on each of said shafts, an endless chain reeved around said sprocket wheels and holders attached to the endless chain and arranged longitudinally thereof at a plurality of positions, each of the holders being channel-shaped and having a web attached to the endless chain and two flanges projecting laterally from the chain, the containers to be sterilized each having a trunk forming a hollow cylinder and two axially spaced annular grooves in the trunk, the distance between said two flanges on each holder being equal to the distance between the two spaced annular grooves on each container, a projecting end of each of said two flanges being recessed in the form of a circular arc to position along the two annular grooves of each container, respectively, said guide rail extending alongside a path of travel of said holders within each vessel over a section thereof from a terminal end of an upper side of the path to a starting end of the upper side of the path via a lower side of the path, the guide rail being at a predetermined distance from each holder so that each container can be held between said guide rail and each holder with said projecting ends of each of said two flanges of each holder engaged in the two annular grooves of each container, respectively, said chain conveyor and said guide rail being each disposed at a predetermined level so that each container, when in each vessel, is above the level of the liquid therein while being held between the guide rail and each holder traveling along the upper side of the path and is below the liquid level while being held between the guide rail and each holder traveling along the lower side of the path.

4. An apparatus as defined in any one of claims 1 to 3 wherein the container inlet is provided with a container aligning unit, and the container outlet is adjacent to a filling unit.

* * * * *